US009696671B1

(12) United States Patent
Massie et al.

(10) Patent No.: US 9,696,671 B1
(45) Date of Patent: Jul. 4, 2017

(54) FUSER BELT TO BE USED IN AN ELECTROPHOTOGRAPHIC PRINTER

(71) Applicant: LEXMARK INTERNATIONAL, INC., Lexington, KY (US)

(72) Inventors: Jean Marie Massie, Lexington, KY (US); Jemboy Tejana Pogoy, Cebu (PH); Giritharan Suppiah, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/052,980

(22) Filed: Feb. 25, 2016

(51) Int. Cl.
*G03G 15/20* (2006.01)

(52) U.S. Cl.
CPC . *G03G 15/2057* (2013.01); *G03G 2215/2016* (2013.01)

(58) Field of Classification Search
CPC ..... G03G 15/2057; G03G 2215/2016
See application file for complete search history.

(56) References Cited

U.S. PATENT DOCUMENTS

| | | | | |
|---|---|---|---|---|
| 6,063,463 | A * | 5/2000 | Schlueter, Jr. | B32B 27/20 399/320 |
| 6,284,373 | B1 | 9/2001 | Ream | |
| 6,558,751 | B2 | 5/2003 | Bellino | |
| 6,689,528 | B2 | 2/2004 | Ream | |
| 6,818,290 | B1 | 11/2004 | Chopra | |
| 7,292,815 | B2 | 11/2007 | Beach | |
| 7,336,919 | B2 | 2/2008 | Beach | |
| 7,352,988 | B2 | 4/2008 | Beach | |
| 7,993,702 | B2 | 8/2011 | Beach | |
| 8,398,532 | B2 | 3/2013 | Gopalanarayanan | |
| 8,522,438 | B2 | 9/2013 | Gopalanarayanan | |
| 8,639,169 | B2 | 1/2014 | Cao | |
| 2014/0235123 | A1* | 8/2014 | Lin | G06F 3/041 442/1 |

* cited by examiner

*Primary Examiner* — Ryan Walsh

(57) ABSTRACT

This invention discloses a polyimide fuser belt incorporating synthetic graphite or expanded synthetic graphite as a filler. The resulting fuser belt has increased thermal diffusivity without sacrificing mechanical strength. Fuser belts made with synthetic or expanded synthetic graphite enable electrophotographic printers to exhibit superior fuse temperatures and better print speeds across a range of different media types.

7 Claims, 1 Drawing Sheet

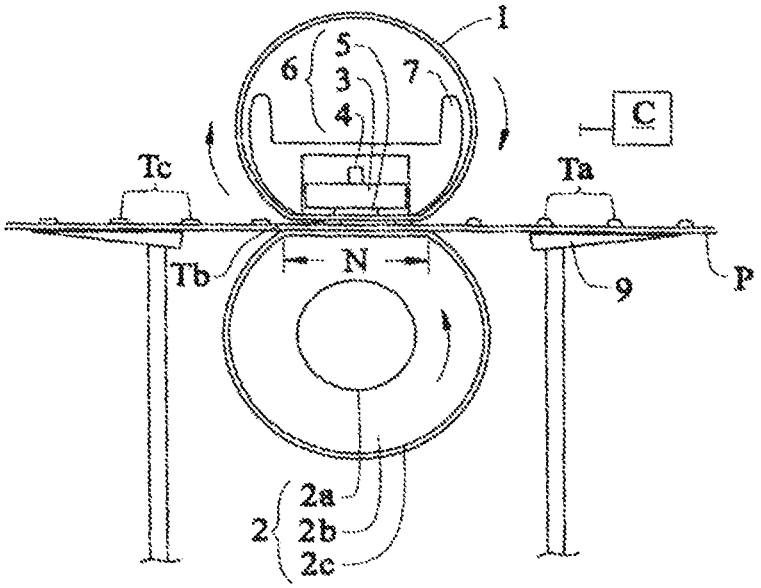
1
5
6
3
7
4
C
Tc
Ta
Tb
N
9
P
2a
2
2b
2c

FUSER BELT TO BE USED IN AN ELECTROPHOTOGRAPHIC PRINTER

CROSS REFERENCES TO RELATED APPLICATIONS

None

BACKGROUND

Field of Invention

The present relates generally to electrophotographic image forming devices, more particularly to polyimide fuser belts used in the heat fixing of toner in an electrophotographic printer. The polyimide fuser belts have increased thermal diffusivity without sacrificing mechanical strength when synthetic graphite or expanded synthetic graphite is used as a filler.

Description of Related Art

This invention relates to polyimide belts used in the heat fixing of toner in an electrophotographic printer. Such belts typically are moved across a heating element while in contact with paper or other media carrying toner to be fixed into such media by fusing. These types of belts, commonly referred to as fuser belts, must enable an electrophotographic printer to meet the demands of lower energy consumption, short time to first print and increased printing speed across a range of different media types.

A fuser belt used in an electrophotographic printer is required to have heat resistance, high thermal diffusivity, high wear resistance and strength with flexibility. A fuser belt is used in a fusing system in an electrophotographic printer to permanently fix or fuse the toned image onto the paper. Fusing of toner on paper is done by means of heat and pressure. This fixing process results in toner that is not easily removed from the paper. Prior to fusing, the toner is loosely bound to the paper and can be easily disturbed or rubbed off.

In belt fusers, toner is fused using a seamless, endless belt which is moved across a ceramic heater. The fuser belt and a backup member (such as a backup roller) act together to form a nip when pressure is applied.

A sheet carrying loose toner in the form of an image is pressed against the belt and heat transmitted by the belt fuses the toner into or onto the sheet. When the substrate carrying the toner passes through this nip, heat from the heated element and pressure within the nip fuse the toner onto the media.

The major process conditions affecting the fuse grade are belt surface temperature, nip time and nip pressure. The nip time is the residence time of the media in the nip. This is controlled by the rotational speeds of the rollers and the nip width. The nip width is determined by the pressure and elasticity of the rollers involved. The nip pressure is determined by the contact force between the rollers and the nip area. Higher temperature and longer nip time improves fuse grade. Increased pressure can also improve fuse grade.

The key print metrics of time to first print, print speed and energy consumption depend on the thickness of the fuser belt, the thermal diffusivity of the fuser belt and the power supplied to the heater. The most effective method of improving these print metrics is to increase the thermal diffusivity of the fuser belt. Accordingly, any method to increase the thermal diffusivity of the fuser belt used in an electrophotographic printer is desirable.

SUMMARY

The present invention is directed to a fuser belt to be used in an electrophotographic printer which incorporates synthetic graphite or expanded synthetic graphite as a filler in a polyimide fuser belt. The polyimide fuser belt using the synthetic graphite or the expanded synthetic graphite has increased thermal diffusivity without sacrificing mechanical strength. Fuser belts made with these graphites as fillers enable electrophotographic printers to meet the demands of lower energy consumption, short time to first print and increased print speeds across a range of different media types.

BRIEF DESCRIPTION OF THE DRAWING

The FIGURE is side, cross-sectioned view of an illustrative belt fuser, which would employ this invention.

DETAILED DESCRIPTION

Fuser belts used in electrophotographic printers must have heat resistance, high thermal diffusivity, high wear resistance and strength with flexibility. Polyimides are useful in a number of high temperature applications because of their excellent heat resistance and mechanical performance. However, like all organic polymers, they are inherently heat insulating. It is known to incorporate inorganic fillers with high thermal conductivity such as boron nitride, carbon black, graphite, and aluminum nitride into a fuser belt to increase the thermal diffusivity of the belt.

Among the above mentioned fillers, boron nitride is most widely used because of its combination of high thermal diffusivity, low dielectric constant (even at high temperatures), non abrading and non toxic properties.

As the thermal demands of electrophotographic printers increase, boron nitride filled polyimide fuser belts no longer meet the thermal requirements demanded by consumers of these types of printers. Typical boron nitride filled polyimide belts contain approximately 20% (wt.) boron nitride with a particle size of 0.5 microns. Higher loadings of boron nitride in the fuser belt increase the thermal diffusivity of the belt at the expense of tube flexibility. This is not a desirable result because the fuser belt becomes too brittle to survive the printing life of the electrophotographic printer. The inventors of the present invention have found that using either a synthetic graphite or an expanded synthetic graphite as a filler in a polyimide fuser belt can impart to the belt a higher desirable thermal diffusivity without sacrificing flexibility.

Synthetic graphite is a manufactured product made by high temperature treatment of amorphous carbon materials. The morphology of most synthetic graphite varies from flakes to fine powders to irregular grains and needles in coarser products. It is available in a variety of particle sizes. Several manufacturers supply synthetic graphite, including Asbury Carbons and Imerys Graphite and Carbon. Commercially available synthetic graphite is manufactured by IMERYS Graphite & Carbon® under the trade names TIMREX® and C-Nergy™.

Expanded graphite is a special form of synthetic graphite. It is also known as "intumescent flake graphite". Expanded graphite is synthesized using an intercalation compound of graphite that expands or exfoliates when heated. Upon heating, the intercalation compounds decompose into gaseous products which result in high inter-graphene pressure. This pressure develops enough force to push apart the graphite basal planes. This results in a graphite with a tenfold increase in surface area. Commercially available expanded graphite is manufactured by Asbury Carbons, Inc. under the trade names EG3775, 3772, 1721, 3721, 1722, 3335, 3577, 3570, 1395, 3558, 3626, 3494 and 3538.

The heat-conductive polyimide film to be used in the fuser belt is made from a polyamic acid solution (polyimide precursor solution) which contains the synthetic or expanded synthetic graphite filler at the desired loading.

The polyamic solution containing the synthetic or expanded synthetic graphite filler can be cast in the form of a seamless tube by a variety of techniques, including spin coating, dip coating, applicator blade coating, and roller coating. In one implementation, a polyimide tube of seamless construction is obtained by applicator blade coating. The polyamic acid containing the synthetic or expanded synthetic graphite is coated by applicator blade coating onto the outer surface of a cylindrical aluminum mandrel that is about 12" long and 1" in diameter. The solution is dried and cured on the surface of the aluminum mandrel. The filled polyimide then can be removed as a seamless tube. Both thermoplastic and thermosetting polyimides can be used but since high temperature resistance for prolonged periods of time and high strength is required for a fusing application, an aromatic type polyimide is preferred.

The polyamic acid used in this invention is obtained by the polymerization of 3,3',4,4' biphenyltetracarboxylic dianhydride and p-phenylenediamine in a polar aprotic solvent such as N-methylpyrrolidinone (NMP) at 65° C. The typical polyamic acid concentration ranges from about 10-20% by weight and the viscosity at 25° C. ranges from 10-2000 Poise. The synthetic or expanded synthetic graphite is incorporated into the polyamic acid using a three roll mill. The synthetic or expanded synthetic graphite content can range from about 5% to about 50% based on the weight of the polyamic acid solids.

FIG. 1 shows an illustrative heating/fixing apparatus using a polyimide film belt consistent with this invention and a ceramic heater. Designated by reference number 1 is a fixing film in the form of an endless belt 1 of this invention. Pressing roller 2 consists of shaft 2*a* typically formed from steel, aluminum, or similar metal; a rubber elastic layer 2*b* made of silicone rubber, and surrounded by parting layer 2*c*, typically consisting of a PFA sleeve. Pressing roller 2 is urged to the bottom surface of heater 6 by a resilient member or other urging means (not shown) providing force of about 4 to 7 kilograms with a bottom travel portion of belt 1 interposed between heater 6 and pressing roller 2. Roller 2 is driven by an attached gear (not shown) through connection with a gear series to the printer mechanism gear train. Movement of film 1 is driven by pressing roller 2 and is in the clockwise direction, thereby moving media P in the corresponding direction through the nip formed by belt 1 and pressing roller 2.

Belt 1 is an endless tube, which is rotated by contact with the driven pressing roller 2 repeatedly for fixing a toner image. Belt 1 therefore is made of a highly heat resistive and durable material having good parting properties. Belt 1 typically has total thickness of not more than about 100 microns, preferably less than about 55 microns.

To facilitate parting of media P, leaving toner on media P, belt 1 typically has an outer layer (not separately shown) of low surface energy material such polytetrafluoroethylene or similar fluoropolymer. A fluoropolymer primer layer is commonly used between the fluoropolymer topcoat and the polyimide layer. It is usually electrically conductive and, in use, electrically connected to an electrical ground at one end. On the lower, opposite surface of belt 1, the surface which contacts the surface of heater 6, a layer of high viscosity lubricant or grease (not separately illustrated) is applied. The outer layer and the amount of grease are thin in relation to total thickness of belt 1, the exact amounts being a routine matter of design choice for specific materials and intended length of service.

Heater 6 comprises, as major components, a heater substrate (base member) 3, typically of ceramic, extending in a direction substantially perpendicular to the direction of movement of belt 1. Base member 3 is electrically insulative, has a high thermal conductivity, and has high heat resistance, as well as having fast warm-up characteristics. One or more heat-generating electrical resistors 5 in a line or stripe extend along the length of base member 3 on the lower surface of base member 3 (i.e., along the face of heater 6 which directly contacts film 1), and a temperature detecting element 4, for example, a thermistor or thermostat, is mounted in contact with the back face of base member 3 (opposite the face having heat-generating resistors 5). The heat retention of the heater 6, as a whole, is low. Heater 6 is fixed to a holder 7 with the bottom face of heater 6 facing the nip, which receives media P. A thin layer of electrical insulation, such a glass (not shown), covers the heat generating resistor 5 portion of the bottom face of heater 6, thereby coming in direct contact with belt 1 on the side opposite the outer, parting layer of belt 1.

The grease is applied only in sufficient amount to coat the entire inside surface of belt 1. Initially the full amount for that purpose may be applied during manufacture on the bottom face of heater 6. Belt 1 is then placed around heater 6. The grease will be distributed to coat the full inside surface of belt 1 during normal use.

Operation is under control of an electronic data processor such as microprocessor C, shown illustratively. Upon generation of an image formation start signal, an image-forming sequence is carried out under control of processor C in an image-forming station (not shown), and recording media P is supplied to the fixing device guided by an inlet guide 9, and is introduced into a nip N (fixing nip) between the temperature-controlled heat 6 and pressing roller 2, more particularly, between fixing belt 1, and pressing roller 2. Media P is passed through fixing nip N at the same speed as belt 1 is moved with the surface of media P having an unfixed electrophotographic toner image Ta being contacted with the bottom surface of belt 1, which is moving in the same direction as media P. Tb is toner in nip N. Loose toner Ta is fused onto media P, such as paper, to form fixed toner Tc.

Preparation of the Polyimide Fuser Belt Using Expanded Graphite

A typical procedure for forming the fuser belt is as follows. An appropriate amount of polyamic acid (3,3',4,4' biphenyltetracarboxylic dianhydride and p-phenylenediamine) in a polar aprotic solvent such as N-methylpyrrolidinone (NMP) at 18% by weight solids is weighed. To this is added the appropriate amount of expanded graphite EG3775 to give 35% by weight solids. For example, for every 100 g of polyamic acid solution at 18% solids, 9.9 g of expanded graphite EG3775 is added. The expanded graphite was supplied by Asbury Carbons, Inc. The mixture is pre-mixed using an air driven propeller. The mixture is then milled in a three roll mill for a total of 3 passes. This dispersion is coated onto the outer surface of a polished aluminum mandrel that has been coated with a release agent to allow the final part to be removed from the mandrel without sticking. In this case an organically modified ceramic was used as the release agent. The coating is applied using a blade coating method. The mandrel is rotated at 250 RPM using a three blade assembly with a translation speed of about 0.15 mm/sec. The gaps between each of the 3 blades and the mandrel were 0.25 mm/0.38 mm/0.56 mm respectively. The coating solution was dispensed periodically in front of each blade to maintain a constant bead. After applying the filled polyamic acid solution, the coated mandrel was removed and transferred to an oven for evaporation of the solvent. The evaporation conditions were 30 minutes at 60° C., followed by 30 minutes at 125° C. The mandrel was continuously rotated while drying to prevent sag and running of the wet coating. Once dry, the mandrel was placed in a high temperature oven for the imidization process. This process converts the polyamic acid into a polyimide. The imidization conditions were 30 minutes at 200° C., followed by 80 min at 250° C., followed by 60 minutes at 380° C.

Upon final cure of the polyimide, the mandrel was removed from the oven and allowed to cool to room temperature. Because of the difference in thermal expansion between the aluminum mandrel and the polyimide, a small gap existed between the mandrel outer surface and the polyimide inner surface. Therefore, removal of the tube becomes a matter of simply sliding the tube off the mandrel. This process resulted in a 50 micron thick polyimide tube.

This polyimide tube in then subsequently coated with a primer such as Chemours 855G-023, then topcoated with a Teflon coating such as Chemours 855G-105. Spray or dip coating is typically used to apply this release layer. This release layer prevents toner from adhering to the belt during fusing. The coated belt is then placed in an oven at 430° C. for 3-4 minutes to cure the coating. The primer thickness is typically 2-3 microns, and the topcoat thickness is 10-15 microns. The filled polyimide tube coated with the release layer is referred to as the polyimide belt.

Preparation of the Polyimide Fuser Belt Using Synthetic Graphite

The process of the polyimide is identical to the procedure outlined in the previous section discussing the preparation of the polyimide fuser belt using expanded graphite. The amount of synthetic graphite filler is adjusted to reflect the desired loading. TIMREX® T15, a synthetic graphite supplied by IMERYS Graphite and Carbon, Inc., was used. TIMREX® T15 has a D90 particle size of approximately 20 microns.

Preparation of the Polyimide Fuser Belt Using Boron Nitride

The process is making the polyimide fuser belt using boron nitrate is identical to the procedure outlined in the previous section discussing the preparation of the polyimide fuser belt using expanded synthetic graphite. The amount of boron nitrate filler is adjusted to reflect the desired loading. The boron nitride used was NX1, supplied by Momentive Performance Materials. It is a hexagonal, graphitic boron nitride with a mean particle size of 0.9 microns.

Test Results

The flexibility of the fuser belt using boron nitride and the fuser belts using synthetic and expanded synthetic graphite were evaluated according to the ASTM test method D2176 with necessary modifications made to the tester so as to perform the test in the single bend mode as compared to the double bend as called for in the ASTM test. A sample of 100 mm length and 15 mm width is folded over a 135 degree angle at a rate of 175 folds per min. A load of 0.5 Lb is used. The flex fatigue is defined as the number of single folds to break. Samples with a flex life of less than 1000 cycles are too brittle.

Thermal diffusivity of the fuser belt using boron nitride and the fuser belts using synthetic graphite and expanded synthetic graphite were measured using the laser flash method. A laser heats the belt sample from one side and a detector on the other side records the time dependent temperature rise. The Cowan method was used to fit the data and calculate the thermal diffusivity. The preferred thermal diffusivity of the belt is >0.3 mm2/s.

A summary of the flex life and thermal diffusivity for the polyimide tube using boron nitride at various loading percentages is listed in Table 1.

TABLE 1

| Boron Nitride Loading (wt %) | Thermal Diffusivity (mm2/s) | Flex Life (Cycles) |
|---|---|---|
| 0 | 0.2 | >200,000 |
| 20 | 0.27 | 135,000 |
| 38 | 0.38 | 2,700 |
| 50 | 0.87 | 1 |

Table 1 illustrates that as the boron nitride loading is increased, the thermal diffusivity is increased, but at the expense of flex life.

A summary of the flex life and thermal diffusivity for the polyimide fuser belts using expanded synthetic graphite and synthetic graphite at various loading percentages is listed in Table 2.

TABLE 2

| Filler Type | Loading (wt %) | Thermal Diffusivity (mm2/s) | Flex Life (cycles to failure) |
|---|---|---|---|
| Boron Nitride | 22 | 0.17 | 189,000 |
| Graphite TIMREX ® T15 | 8 | 0.19 | >250,000 |
| | 23 | 0.21 | 121,000 |
| | 38 | 0.38 | 3,937 |
| Expanded graphite EG3775 | 35 | 0.33 | 41,924 |
| | 40 | 0.58 | 220 |
| | 45 | 0.57 | 35 |

As seen from the testing data reported in Tables 1 and 2, both the expanded synthetic graphite and the synthetic graphite give higher thermal diffusivity while maintaining flexibility to their fuser belts compared to the fuser belt using boron nitride.

Next the fuse grade of the toned image on the page was tested using a crock cloth affixed to a linear taber abrader. The amount of the toner removed from the fused image was measured. The cloth was rubbed against a 2 inch long section of a fused image. The fused image is a series of individual lines of different thicknesses. The cloth was removed and the optical density of the toner on the cloth is measured using a densitometer. Higher optical density indicates that more toner is removed from the fused page, thereby signifying a worse fuse grade result. The maximum optical density (OD) of the toner on the cloth allowed for acceptable fuse grade is specified. The fuse grade specification for each media type is shown in Tables 3-5.

The fuser belts were tested in a mono electrophotographic printer at various fusing temperatures and print speeds, across a range of media types. The polyimide boron nitride (20% wt) fuser belt was compared to a polyimide expanded graphite (38% wt.) fuser belt. Testing results are shown in Tables 3-5 below.

TABLE 3

| Fuse Grade at 50 ppm - Letter | | | |
|---|---|---|---|
| | Filler | | |
| Fusing Temperature (° C.) | Boron Nitride | Expanded Graphite | TIMREX ® T15 Graphite |
| 210 | 0.22 | 0.12 | .17 |
| 220 | 0.11 | 0.08 | .09 |
| 230 | 0.10 | 0.07 | .08 |

Fuse Grade Specification: OD < 0.20

TABLE 4

| Fuse Grade at 50 ppm - Labels | | |
|---|---|---|
| | Filler | |
| Fusing Temperature (° C.) | Boron Nitride | Expanded Graphite |
| 230 | 0.63 | 0.34 |
| 240 | 0.53 | 0.28 |

Fuse Grade Specification: OD < 0.39

TABLE 5

| Fuse Grade at 220° C. Fusing Temperature - Letter | | | |
|---|---|---|---|
| | Filler | | |
| Print Speed (ppm) | Boron Nitride | Expanded Graphite | TIMREX ® T15 Graphite |
| 50 | .11 | .08 | .09 |
| 55 | .21 | .11 | .14 |
| 60 | .40 | .20 | .27 |

Fuse Grade Specification: OD < 0.20

Tables 3-5 show that the polyimide fuser belt using expanded synthetic graphite as a filler gives superior fusing properties compared to the polyimide fuser belt using boron nitride as a filler. Accordingly the increased thermal diffusivity of the fuser belts using the synthetic or expanded synthetic graphite as a filler enables the electrophotographic printer to have increased print speed at a given fusing temperature, reduced fusing temperature at a given print speed, faster time to first print, full speed label printing, faster printing with heavier media and reduced energy consumption.

What is claimed is:

1. A seamless endless belt for a heat fuser having a polyimide resin body and synthetic graphite incorporated within the polyimide resin body as a filler, wherein the seamless endless belt having the synthetic graphite filler has increased thermal diffusivity without sacrificing mechanical strength, wherein the synthetic graphite is expanded graphite, wherein the polyimide is a reaction product of a polyamic acid solution of 3,3',4,4' biphenyltetracarboxylic dianhydride and p-phenylenediamine in a polar aprotic solvent 65° C., and wherein the synthetic graphite can range from about 5% to about 50% based on the weight of polyamic acid solids.

2. The seamless endless belt of claim 1, wherein the expanded synthetic graphite is synthesized using an intercalation compound of graphite that expands when heated.

3. The seamless endless belt of claim 1, wherein the polar aprotic solvent is N-methylpyrrolidinone.

4. A toner fixing system comprising a heating element to generate heat for fusing electrophotographic toner;

a seamless endless belt with a surface in contact with said heating element movable in contact with said heating element;

a back up member in nip position with said belt where said belt contact said heating element; and a media feed path to feed media carrying unfixed toner images through said nip;

wherein the seamless endless belt has a polyimide resin body and synthetic graphite incorporated within the polyimide resin body as a filler, wherein the polyimide is a reaction product of a polyamic acid solution of 3,3',4,4' biphenyltetracarboxylic dianhydride and p-phenylenediamine in a polar aprotic solvent at 65° C., and wherein the synthetic graphite can range from about 5% to about 50% based on the weight of polyamic acid solids.

5. The toner fixing system of claim 4, wherein the synthetic graphite is expanded graphite.

6. The toner fixing system of claim 5, wherein the expanded synthetic graphite is synthesized using an intercalation compound of graphite that expands when heated.

7. The toner fixing system of claim 4, wherein the polar aprotic solvent is N-methylpyrrolidinone.

* * * * *